US005918664A

United States Patent [19]

Torigoe

[11] Patent Number: 5,918,664

[45] Date of Patent: Jul. 6, 1999

[54] REFRIGERANT EVAPORATOR CONSTRUCTED BY A PLURALITY OF TUBES

[75] Inventor: Eiichi Torigoe, Kariya, Japan

[73] Assignee: Denso Corporation, Kariya, Japan

[21] Appl. No.: 09/024,046

[22] Filed: Feb. 16, 1998

[30] Foreign Application Priority Data

Feb. 26, 1997 [JP] Japan ..... 9-042632

[51] Int. Cl.[6] ..... F28D 1/03

[52] U.S. Cl. ..... 165/78; 165/76; 165/153

[58] Field of Search ..... 165/153, 176, 165/76, 78

[56] References Cited

U.S. PATENT DOCUMENTS 4,274,482 6/1981 Sonoda ..... 165/153
4,592,414 6/1986 Beasley ..... 165/76
4,621,685 11/1986 Nozawa ..... 165/111

FOREIGN PATENT DOCUMENTS

A-2-263069 10/1990 Japan .
4-59425 2/1992 Japan ..... 165/153

*Primary Examiner*—Allen Flanigan
*Attorney, Agent, or Firm*—Harness, Dickey & Pierce, PLC

[57] ABSTRACT

In a refrigerant evaporator constructed by laminating a plurality of tubes in which an inlet side refrigerant passage and an outlet side refrigerant passage are formed, a connecting member which sets a position of the adjacent tubes is provided. The connecting member is formed at inlet tank portions of the tube through which the refrigerant having a lower dryness is small flows. Thus, the adjacent tubes are connected firmly, and pressure loss of the refrigerant is decreased at the same time.

11 Claims, 9 Drawing Sheets

REFRIGERANT EVAPORATOR CONSTRUCTED BY A PLURALITY OF TUBES

CROSS REFERENCE TO RELATED APPLICATION

This application is based on and incorporates herein by reference Japanese Patent Application No. Hei. 9-42632 filed on Feb. 26, 1997.

BACKGROUND OF THE INVENTION

1. Field of the Invention

The present invention relates to a refrigerant evaporator which is constructed by laminating a plurality of tubes made of a couple of metal thin plates having a first refrigerant passage, a second refrigerant passage and four tank portions at their upper and lower ends.

2. Description of Related Art

The inventors of the present invention have disclosed a refrigerant evaporator 1 having a refrigerant route as shown in FIG. 4 in Japanese Patent Application No. 9-22844. In the evaporator 1, an inlet side heat exchanging portion 3*a* is formed at an air down stream side, and an outlet side heat exchanging portion 3*b* is formed at an air upstream side. Here, an arrow A denotes an air flow direction. The inlet side heat exchanging portion 3*a* communicates with an upper side inlet tank portion 47 and a lower side inlet tank portion 48. The outlet heat exchanging portion 3*b* is communicated with an upper side outlet tank portion 43 and a lower side outlet tank portion 44. In the heat exchanging portions 3*a* and 3*b*, a heat exchange between refrigerant flowing in the evaporator 1 and the air is carried out. The lower side inlet tank portion 48 is separated into a first inlet tank portion "a" and a second inlet tank portion "b" by a partition plate 51. The upper side outlet tank portion 43 is separated into a first outlet tank portion "c" and a second outlet tank portion "d".

In the evaporator 1, as show in FIG. 9, a tube 2 through which the refrigerant flows is constructed by connecting a couple of metal plates 4 to face each other. An inside of the tube 2 is partitioned into an outlet side (air upstream side) refrigerant passage 2*a* and an inlet side (air downstream side) refrigerant passage 2*b* by a center rib 49. At both upper and lower ends of the tube 2, tank portions 47, 48, 43 and 44 which communicate with the refrigerant passages 2*a* and 2*b* are formed into a shape like a columnar concave. In each tank portion 47, 48, 43 or 44, communication holes 45, 46, 41 and 42 which connect the tank portions 47, 48, 43 and 44 of adjacent tubes 2 are formed.

In FIG. 4, the refrigerant flows inside the evaporator 1 in accordance with the following route;

"inlet pipe 8*a*→inlet side communicating portion 15→first inlet tank portion "a"→inlet side refrigerant passages 2*a*→upper side inlet tank portion 47→inlet side refrigerant passages 2*a*→second inlet tank portion "b"→refrigerant passage 13→first outlet tank portion "c"→outlet side refrigerant passages 2*b*→lower side outlet tank portion 44→outlet side refrigerant passages 2*b*→second outlet tank portion "d" outlet side communicating portion 14→refrigerant outlet pipe 8*b*". Here, the inlet pipe 8*a* and the outlet pipe 8*b* is connected to the left side of the evaporator 1. The inlet side communicating portion 15 and the outlet side communicating portion 14 are formed at the left side of the evaporator 1. The refrigerant passage 13 is formed at the right side of the evaporator 1.

In this way, with respect to the air flow A, the outlet side heat exchanging portion 3*b* is disposed at the air upstream side, and the inlet side heat exchanging portion 3*a* is disposed at the air downstream side. In the inlet side heat exchanging portion 3*a* and the outlet side heat exchanging portion 3*b*, the refrigerant flows in the same direction. That is, in FIG, 4, at the right side of the partition plates 51 and 52 in the heat exchanging portions 3*a* and 3*b*, the refrigerant flows downwardly, while at the left side of the partition plates 51 and 52, the refrigerant flows upwardly.

The evaporator 1 is manufactured by laminating the metal plate 4 made of aluminum as shown in FIG. 9 to assemble an evaporator structure and brazing it in the brazing furnace. When the evaporator structure is temporarily assembled, the coupled metal plates 4 facing each other are not to be set off with each other, because the contacting area therebetween is comparatively large for they contact each other at the outer peripheries of the metal plate 4 and the center rib 49. However, the metal plates 4 being adjacent to each other tend to be set off, because the contacting area therebetween is small for they contact each other at only the protruded surfaces of their tank portions 43, 44, 47 and 48.

SUMMARY OF THE INVENTION

A first object of the present invention is to fix metal plates being adjacent to each other firmly and to prevent them from being set off when an evaporator structure is temporarily assembled before being brazed.

A second object of the present invention is to decrease the pressure loss while the adjacent metal plates are fixed firmly by attaining the above first object.

According to the first aspect of the present invention, connecting members which set a position of the adjacent tubes are provided in the inlet tank portions through which the refrigerant having a lower dryness flows. Thus, the adjacent tubes are fixed firmly, and pressure loss increase is prevented and the cooling ability is enhanced at the same time.

According to the second aspect of the present invention, the connecting member consists of a first connecting member and a second connecting member. The first connecting member is protruded from one side of a first inlet tank portion and inserted into the other side of a first inlet tank portion located adjacent thereto, and the second connecting member is protruded from the other side of a second inlet tank portion and inserted into one side of a second inlet tank portion located adjacent thereto. Further, the four tank portions are formed into the same shape. Thus, the tube is constructed by only one kind of metal plate, accordingly, the cost of manufacturing this evaporator can be reduced.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

Figure 1:
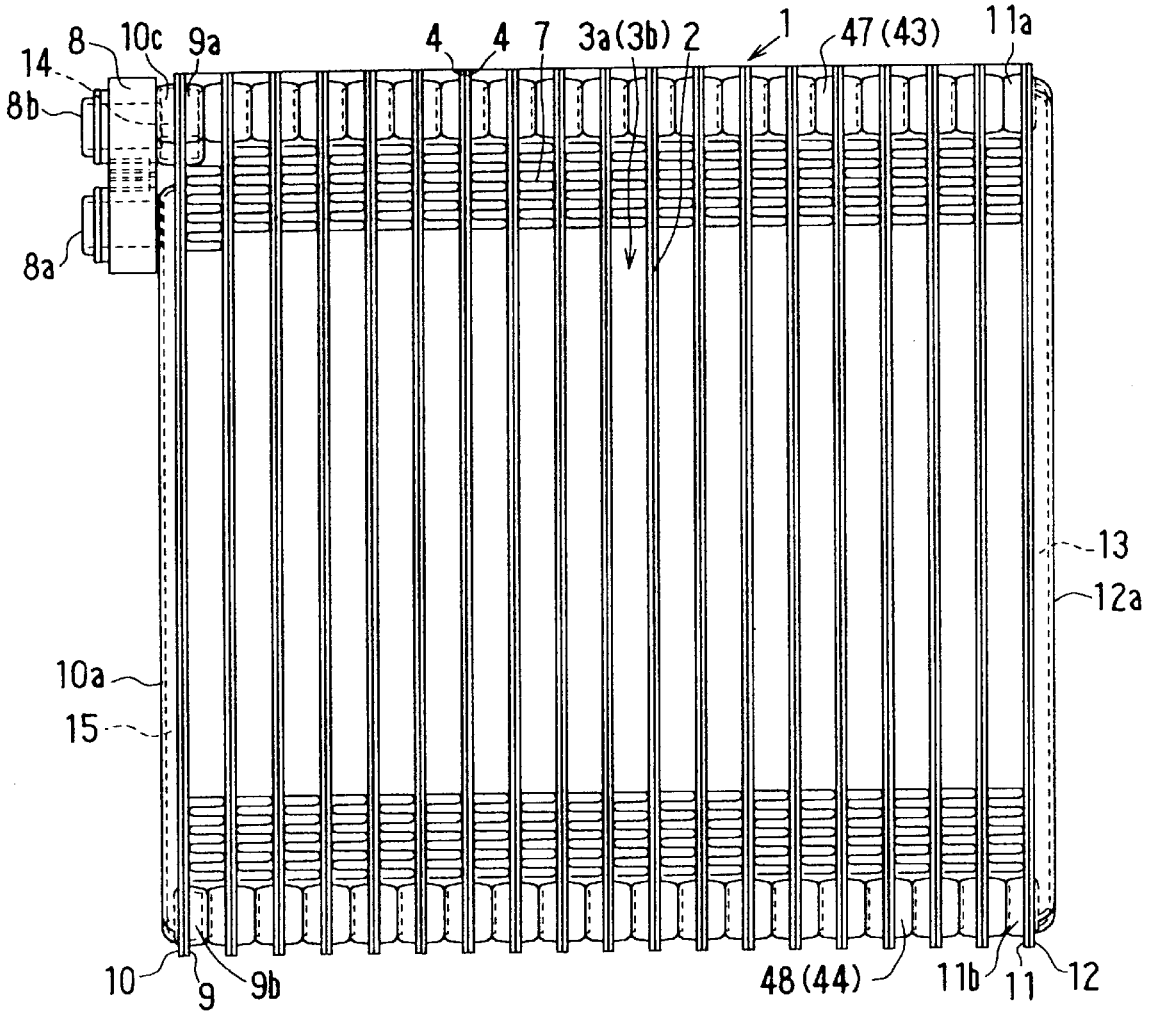
FIG. 1 is a front view showing a refrigerant evaporator according to the present invention.

Referring to the drawings, preferred embodiments of the present invention will be described.

First Embodiment

An evaporator 1 is disposed in the cooling unit (not illustrated) of an air conditioning apparatus for a vehicle. In FIG. 1, a pipe joint 8 is provided at the left end of the evaporator 1. The outlet pipe of a temperature responsive expansion valve (not illustrated) is connected to the refrigerant inlet pipe 8*a* of the pipe joint 8. A low temperature and low pressure gas-liquid phase refrigerant having been pressure-reduced and expanded by the expansion valve flows into the refrigerant inlet pipe 8*a*.

Figure 2:
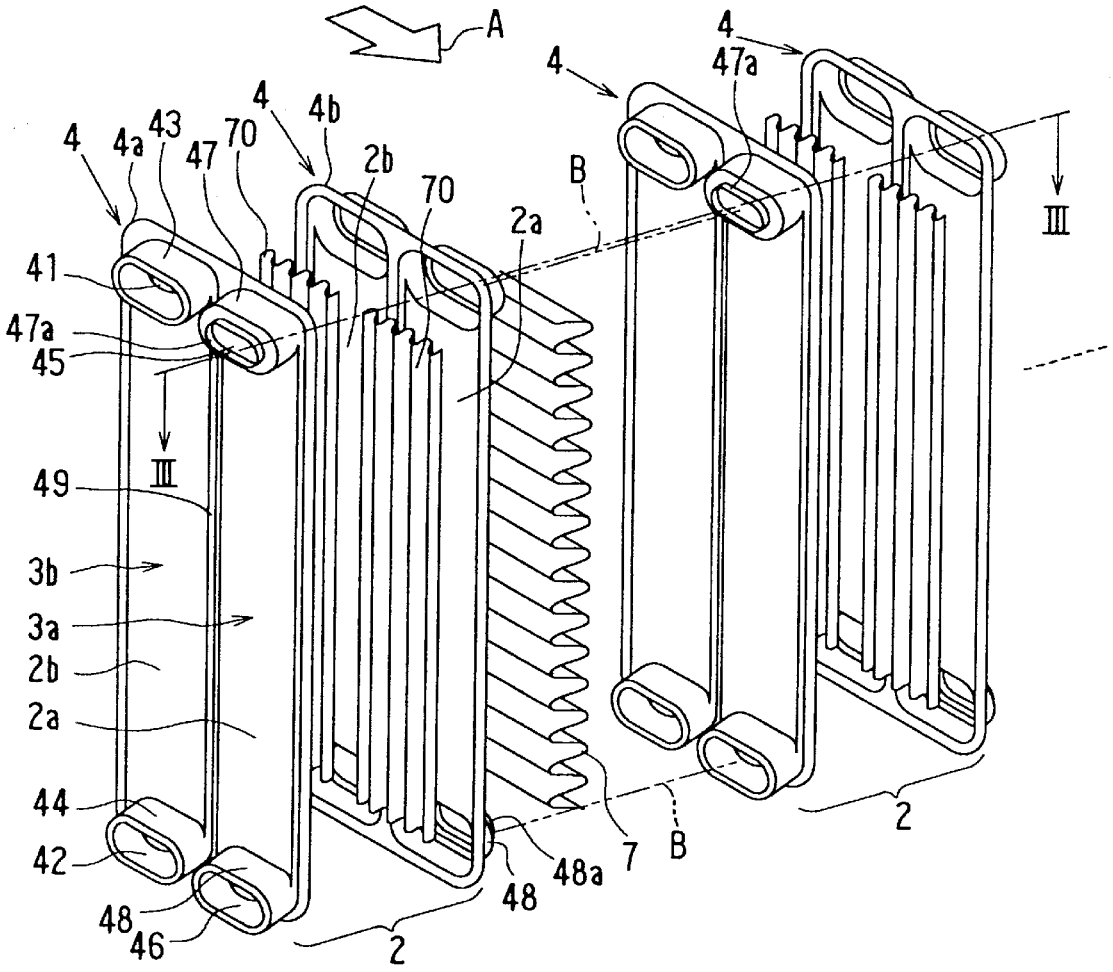
FIG. 2 is a perspective dealing view showing a principal part of the evaporator according to the first embodiment.
Figure 4:
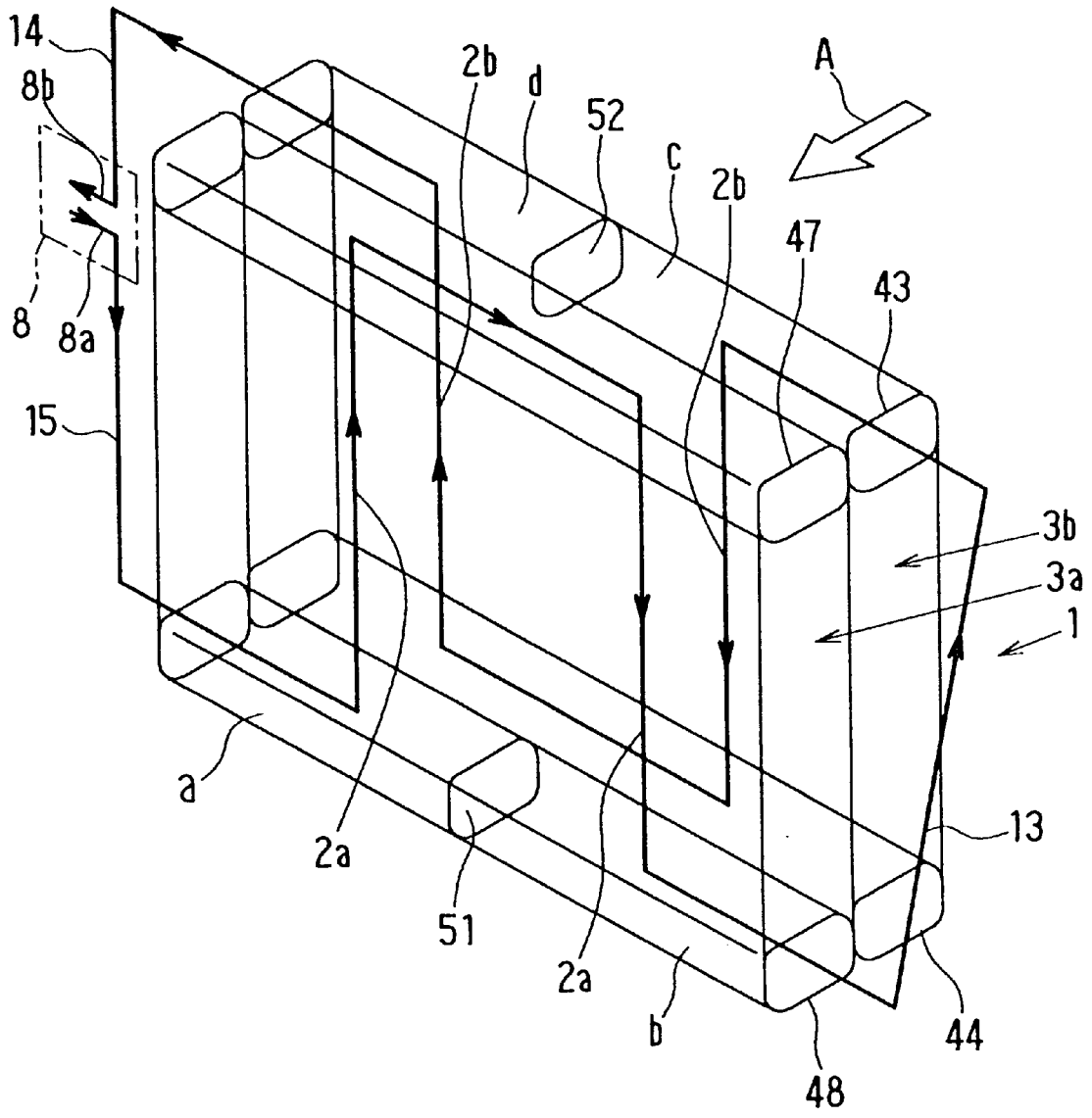
FIG. 4 is a schematic perspective view showing the refrigerant flow route in the evaporator according to the first embodiment.

The evaporator 1 includes an inlet side heat exchanging portion 3*a* and an outlet side heat exchanging portion 3*b*. The inlet side heat exchanging portion 3*a* and the outlet side heat exchanging portion 3*b* are constructed integrally by a plurality of tubes 2 arranged in parallel. In the tube 2, an inlet side (air downstream side) refrigerant passage 2*a* and an outlet side (air upstream side) refrigerant passage 2*b* are formed (see FIG. 2). In the inlet side heat exchanging portion 3*a*, heat exchange between the refrigerant flowing inside the inlet side refrigerant passage 2*a* and the air flowing outside the tube 2 is carried out, while in the outlet side heat exchanging portion 3*b*, a heat exchange between the refrigerant flowing inside the outlet side refrigerant passage 2*b* and the air flowing outside the tube 2 is carried out. In FIGS. 2 and 4, an arrow A denotes an air flowing direction.

The tube 2 is formed by a couple of metal plates 4 facing each other. As the metal plate 4, a brazing sheet (thickness: about 0.4–0.6 mm) obtained by cladding an aluminum brazing material (for example A4000) on the two surfaces of an aluminum core material (for example A3000) is used, and the brazing sheet is formed into the shape as shown in FIG. 2. The inlet side heat exchanging portion 3*a* and the outlet side heat exchanging portion 3*b* are constituted by laminating a large number of tubes 2 and joining them by brazing.

Inside the tube 2, the inlet side refrigerant passage 2*a* and the outlet side refrigerant passage 2*b* are partitioned by a center rib 49. These refrigerant passages 2*a* and 2*b* are formed in parallel to the longitudinal direction of the metal plate 4 and in such a manner that their width dimensions are equal to each other.

At both upper and lower ends of the metal plate 4, an upper side inlet tank portion 47 and a lower side inlet tank portion 48 having a communication hole 45 and 46 respectively are formed. In a similar way, at both upper and lower ends of the metal plate 4, an upper side outlet tank portion 43 and a lower side outlet tank portion 44 having a communication hole 41 and 42 respectively are formed. The communication holes 45 and 46 connect the inlet side refrigerant passages 2*a* of each metal plate 4 with each other, and the communication holes 41 and 42 connect the outlet side refrigerant passages 2*b* of each metal plate 4 with each other. These tank portions 43, 44, 47 and 48 are formed into a shape of an ellipse columnar protrusion portion protruding toward the outside of the metal plate 4. These tank portions 43, 44, 47 and 48 are formed into the same shape, and these communication holes 41, 42, 45 and 46 are also formed into the same shape.

In the heat exchanging portions 3*a* and 3*b*, inside each of the refrigerant passages 2*a* and 2*b*, an inner fin 70 to increase the heat transmitting surface area and the strength of the tube 2 is provided. The inner fin 70 is arranged in such a manner that the ridge direction thereof is parallel to the longitudinal direction of the tube 2. Therefore, inside of each refrigerant passage 2*a* and 2*b* is separated into some small refrigerant passages in parallel. Between the adjacent tubes 2, a corrugated fin 7 is provided. The fin 7 increases the heat transmitting surface area in the air flowing side of the heat exchanging portions 3*a* and 3*b*. The fin 7 is made of an aluminum-bare (for example A3003) not being clad with an aluminum brazing material and formed into a wave shape.

At one end of the heat exchanging portions 3*a* and 3*b* (the left end in FIG. 1), a side plate 9 and an end plate 10 are provided. The end plate 10 is connected to the side plate 9. At the other end of the heat exchanging portions 3*a* and 3*b* (the right end in FIG. 1), a side plate 11 and an end plate 12 are provided. The end plate 12 is connected to the side plate 11. These side and end plates 9, 10, 11 and 12 are made of the same brazing sheet as the metal plate 4. Here, the thickness of these plates 9, 10, 11 and 12 is set to be thicker than that of the metal plate 4, for example about 1.0–1.6 mm, for providing a sufficient strength.

At the upper and lower ends of the side plate 9, an outlet tank portion 9*a* and an inlet tank portion 9*b* are formed respectively. Each tank portion 9*a* and 9*b* is formed as an oval-shaped concave portion elongating in the width direction of the side plate 9. In each outlet tank portion 9*a* and the inlet tank portion 9*b*, a communication hole (not illustrated) is formed.

At the upper and lower ends of the side plate 11, also, an outlet tank portion 11*a* and an inlet tank portion 11*b* are formed respectively. Each tank portion 11*a* and 11*b* is formed as an oval-shaped concave portion elongating in the width direction of the side plate 11. In each upper outlet tank portion 11*a* and the inlet tank portion 11*b*, a communication hole (not illustrated) is formed.

The end plate 10 is provided with protrusion portions 10*a* and 10*c* protruding toward the outside of the heat exchanging portions 3*a* and 3*b*. An inlet side communicating portion 15 (fluid passage) is formed in a space surrounded by the protrusion portion 10*a*, the flat surface of the side plate 9 and the inlet tank portion 9*b*. An outlet side communicating portion 14 (fluid passage) is formed in a space between the protrusion portion 10*c* and the outlet tank portion 9*a*. Here, the protrusion portions 10*a* and 10*c* are arranged such that the refrigerant in the inlet side communicating portion 15 and the refrigerant in the outlet side communicating portion 14 do not communicate with each other. Like the end plate 10, the end plate 12 is provided with a protrusion portion 12*a* protruding toward the outside of the heat exchanging portions 3*a* and 3*b*. A refrigerant passage 13 is formed in a space between the protrusion portion 12*a* and the flat surface of the side plate 11 is formed.

In the protrusion portion 10*a*, a communication hole (not illustrated) which communicates with the refrigerant inlet pipe 8*a* of the pipe joint 8 is formed. In the protrusion portion 10*c*, a communication hole which communicates with the refrigerant outlet pipe 8*b* of the pipe joint 8.

To the refrigerant inlet pipe 8*a*, the outlet refrigerant pipe of the expansion valve is connected, while to the refrigerant outlet pipe 8*b*, a compressor suction pipe which introduces the gas phase refrigerant evaporated by the evaporator 1 into the compressor is connected.

FIG. 4 is a schematic perspective view of the refrigerant passage route in the evaporator 1. At a predetermined position inside the lower side inlet tank portion 48, a first partition plate 51 is disposed, while at a predetermined position inside the upper side outlet tank portion 43, a second partition plate 52 is disposed. The first partition plate 51 is formed by closing the communication hole 46 in the lower side inlet tank portion 48 of the metal plate 4. The second partition plate 52 is formed by closing the communication hole 41 in the upper outlet side tank portion 43 of the metal plate 4.

By disposing the first partition plate 51, the lower side inlet tank portion 48 is separated into a first inlet tank portion "a" and a second inlet tank portion "b". By disposing the second partition plate 52, the upper side outlet tank portion 43 is separated into a first outlet tank portion "c" and a second outlet tank portion "d".

According to the above-described structure, the refrigerant flows inside the evaporator 1 through the following route:

"refrigerant inlet pipe 8*a*→inlet side communicating portion 15→first inlet tank portion "a"→inlet side refrigerant passages 2*a*→upper side inlet tank portion 47→inlet side refrigerant passages 2*a*→second inlet tank portion "b"→refrigerant passage 13→first outlet tank portion "c"→outlet side refrigerant passages 2*b*→lower side outlet tank portion 44→outlet side refrigerant passages 2*b*→second outlet tank portion "d"→outlet side communicating portion 14→refrigerant outlet pipe 8*b*".

In this way, temperature of the air flowing in the direction of the arrow A at the downstream side of the evaporator 1 is equalized in the entire area of the heat exchanging portions 3*a* and 3*b*.

The assembling step of the evaporator 1 according to the present embodiment will be explained.

At first, the metal plate 4, corrugate fin 7, side plates 9 and 11, and the end plates 10 and 12 are stacked, and after that the pipe joint 8 is connected to the end plate 10. In this way, a temporary assembly of a predetermined structure of the evaporator 1 is provided.

Next, by binding the temporarily assembled structure of the evaporator 1 from the outsides of the end plates 10 and 12 tightly with a wire (not illustrated), the temporarily assembled condition of the evaporator 1 is held.

Finally, the temporarily assembled structure of the evaporator 1 is carried into a brazing furnace and heated to the melting point of the aluminum brazing material, then each connecting part of the temporarily assembled structure of the evaporator 1 is fixed by brazing.

Here, according to the present embodiment, for setting a position of each tank portion during the temporary assembling step and for reducing the pressure loss of the refrigerant, the following featured structure is adopted.

Figure 3:
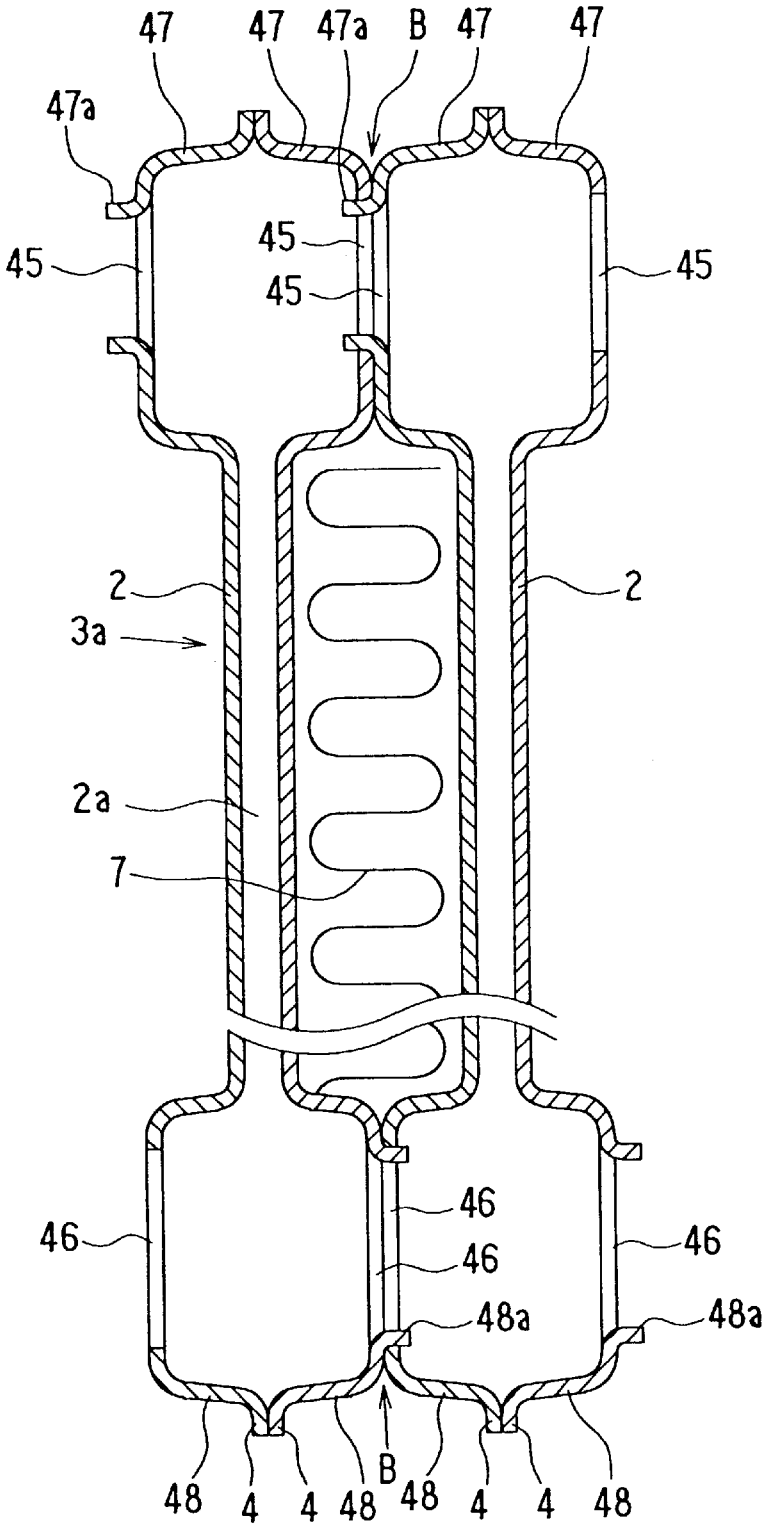
FIG. 3 is a cross sectional view taken along a line III—III in FIG. 2.

That is, as shown in FIG. 3, at the periphery of the communication hole 45 in the upper side inlet tank portion 47 of the tube 2, a projection 47*a* protruding toward the left side for setting the position of the tank portion is formed integrally. This projection 47*a* is formed into an ellipse-columnar shape at only one side (left side in FIG. 3) of the upper side inlet tank portion 47 of each tube 2. The projection 47*a* is inserted into the other side (right side in FIG. 3) communication hole 45 of the abutting tube 2. In a similar way, at the periphery of the communication hole 46 in the lower side inlet tank portion 48, a projection 48*a* protruding toward the right side for setting the position of the tank portion is formed integrally. This projection 48*a* is also formed into an ellipse-columnar shape at only the other side (right side in FIG. 3) of the lower side inlet tank portion 48 of each tube 2. The projection 48*a* is inserted into the one side (left side in FIG. 3) communication hole 46 of the abutting tube 2.

In this way, between the adjacent tubes 2, two connecting members B for setting the position of the adjacent tank portions 47 and 48 are provided. Here, according to the present embodiment, the diameters of the communication holes 45 and 46 are set to 23.8 mm, inner diameters of the projections 47*a* and 48*a* are set to 21.8 mm and the thicknesses thereof are set to 1.5 mm, for example.

Thereby, when the evaporator 1 is temporarily assembled, by inserting the projections 47*a* and 48*a* into the communication holes 45 and 46 respectively, adjacent tubes 2 are correctly positioned. Further, by brazing the position setting connecting member B, the connecting strength of these tubes 2 is increased.

Because the tank portions 43, 44, 47 and 48 are formed into the same shape and the communication holes 41, 42, 45 and 46 are also formed into the same shape, practically, the heat exchanging portions 3*a* and 3*b* are provided by forming the projection 47*a* or 48*b* at only one of the four tank portions 43, 44, 47 and 48 in the metal plate 4 and assembling these metal plates 4 in such a manner that the projection 47*a* or 48*a* is positioned as above-mentioned. In short, the tubes 2 according to the present embodiment are formed by only one kind of metal plate 4.

In the present embodiment, the position setting connecting members B are formed in the inlet tank portions 47 and 48 through which the refrigerant having a lower dryness flows. Thus, reducing the pressure loss of the refrigerant and preventing the cooling ability from reducing are more provided than the case that the position setting connecting members B are formed in the outlet tank portions 47 and 48 through which the refrigerant having a higher dryness flows. Further, since the tube 2 is constructed by only one kind of metal plate 4, the cost of manufacturing this evaporator 1 can be reduced.

Second Embodiment

Figure 5:
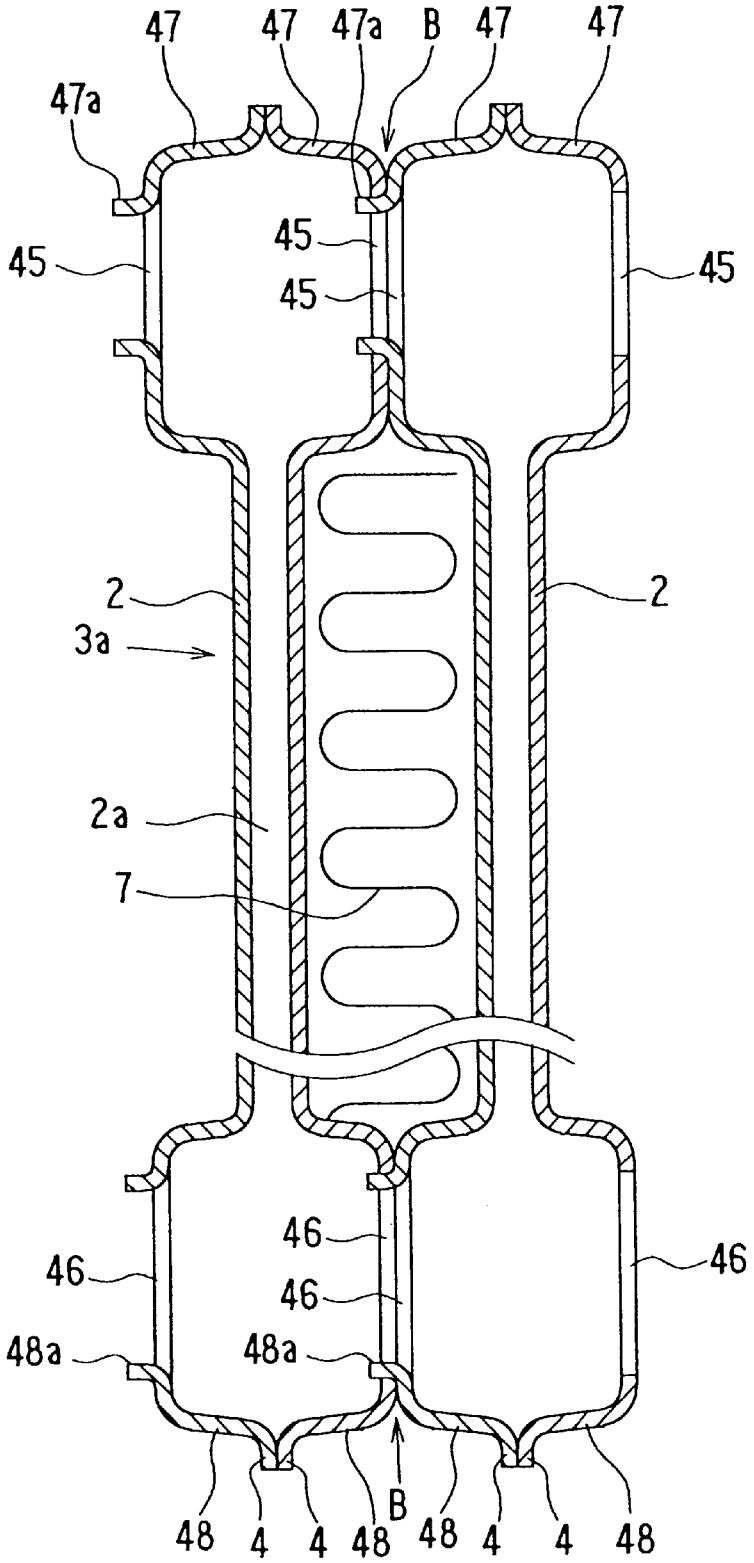
FIG. 5 is a cross sectional view showing a principal part of the evaporator according to the second embodiment.

In the second embodiment, as shown in FIG. 5, at the periphery of the communication hole 45 in the upper side inlet tank portion 47 of the tube 2, a projection 47*a* protruding toward the left side for setting the position of the tank portion is formed integrally with the upper side inlet tank portion 47. This projection 47*a* is formed into an ellipse-columnar shape at only one side (left side in FIG. 5) of the upper side inlet tank portion 47 of each tube 2. The projection 47*a* is inserted into the other side (right side in FIG. 3) communication hole 45 of the abutting tube 2. In a similar way, at the periphery of the communication hole 46 in the lower side inlet tank portion 48, a projection 48*a* protruding toward the left side for setting the position of the tank portion is formed integrally with the lower side inlet tank portion 48. This projection 48*a* is also formed into an ellipse-columnar shape at the same side as the projection 47*a* (left side in FIG. 5) of the lower side inlet tank portion 48 of each tube 2. The projection 48*a* is inserted into the other side (right side in FIG. 5) communication hole 46 of the abutting tube 2.

According to the second embodiment, the tube 2 is formed by two kinds of metal plate 4. That is, the heat exchanging portions 3*a* and 3*b* are constructed by laminating the metal plate 4 having two projections 47*a* and 48*a* at predetermined positions and the metal plate 4 having no such a projection.

Third Embodiment

Figure 6:
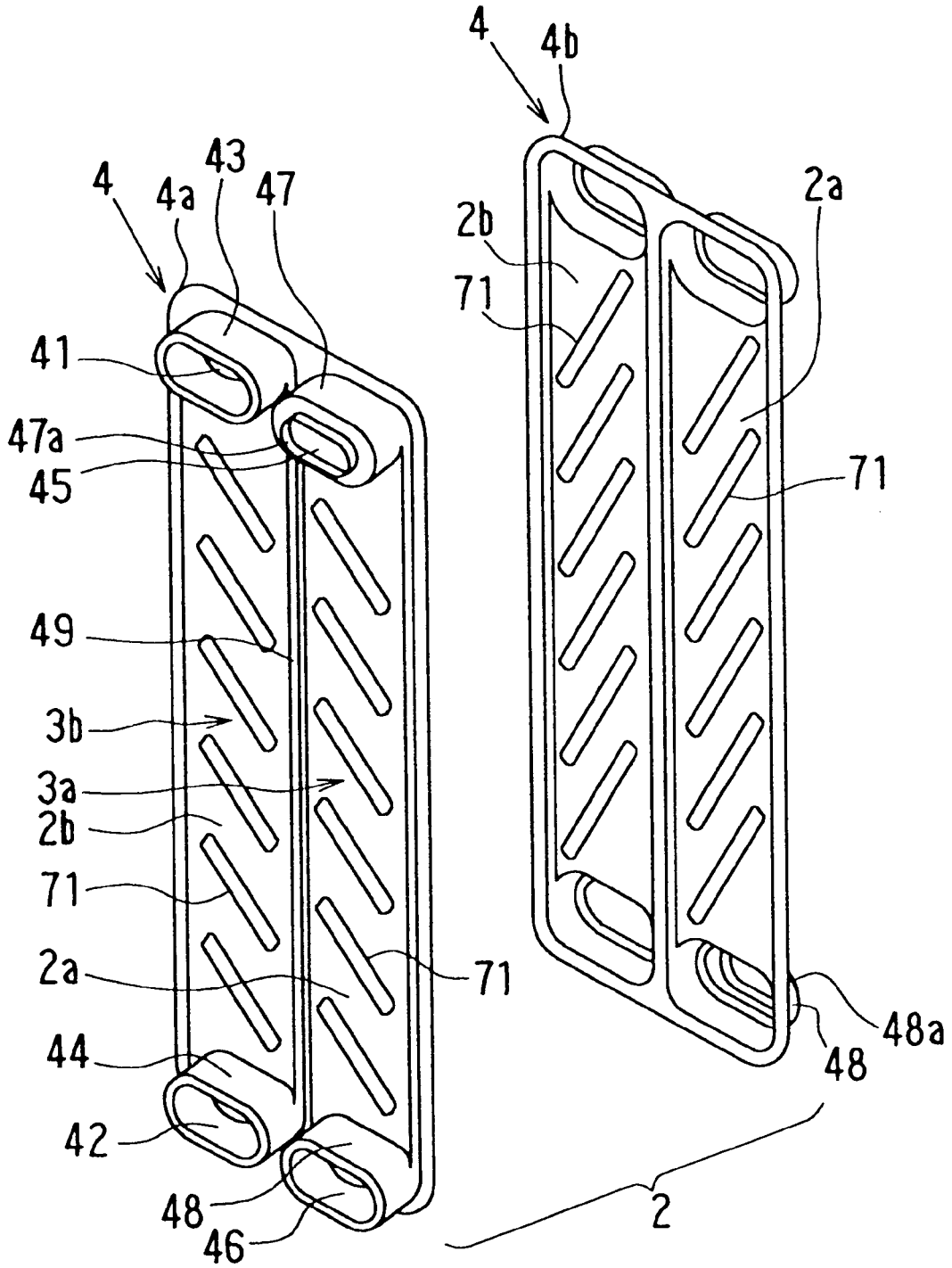
FIG. 6 is a perspective dealing view showing a tube according to the third embodiment.

According to the third embodiment, as shown in FIG. 6, inside the refrigerant passages 2*a* and 2*b* formed in the metal plate 4, a plurality of rectangular-shaped ribs 71 are formed, and the inner fin 70 in the first embodiment is eliminated. The rectangular-shaped ribs 71 are formed in such a manner that they are arranged diagonally with an angle of about 45° with respect to the longitudinal direction (upper and lower direction in FIG. 6) of the metal plate 4. When the coupled metal plates 4 are connected to face each other, the rectangular-shaped rib 71 formed on one metal plate 4 and the rectangular-shaped rib 71 formed on the other metal plate 4 are placed to cross and contact to each other. In this way, according to the third embodiment, the heat transmitting surface area inside the refrigerant passages 2*a* and 2*b* is enlarged, and the strength of the tube 2 is increased at the same time.

Fourth Embodiment

Figure 7:
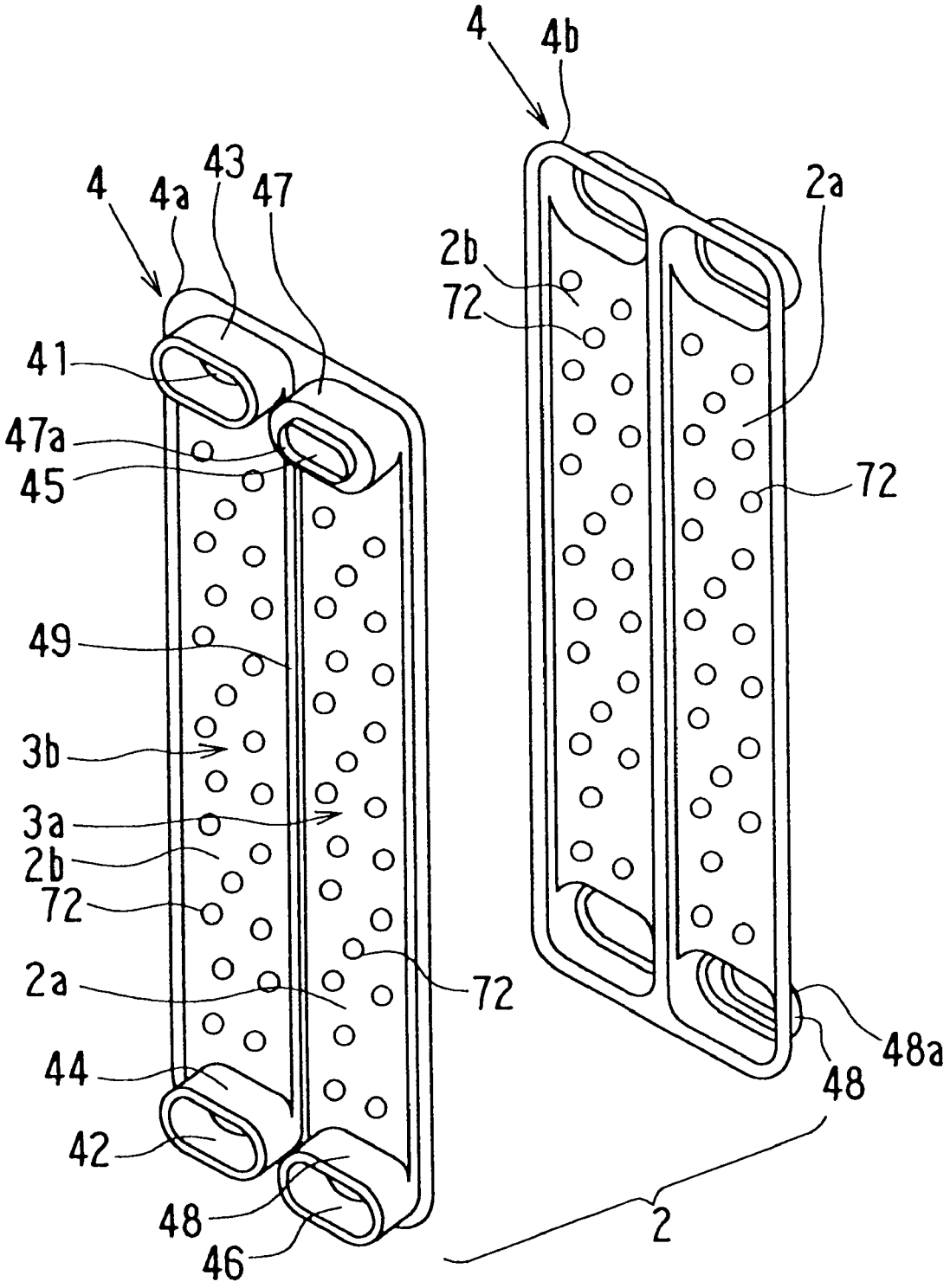
FIG. 7 is a perspective dealing view showing a tube according to the fourth embodiment.

In the fourth embodiment, as shown in FIG. 7, inside the refrigerant passages 2*a* and 2*b*, a plurality of dimples 72 are formed, and the inner fin 70 in the first embodiment is eliminated. When the coupled metal plates 4 are connected to face each other, the top of the dimples 72 formed on one metal plate 4 contacts to the inside surface of the other metal plate 4. In this way, according to the fourth embodiment, the heat transmitting surface area inside the refrigerant passages 2*a* and 2*b* is enlarged, and the strength of the tube 2 is increased at the same time.

Fifth Embodiment

Figure 8:
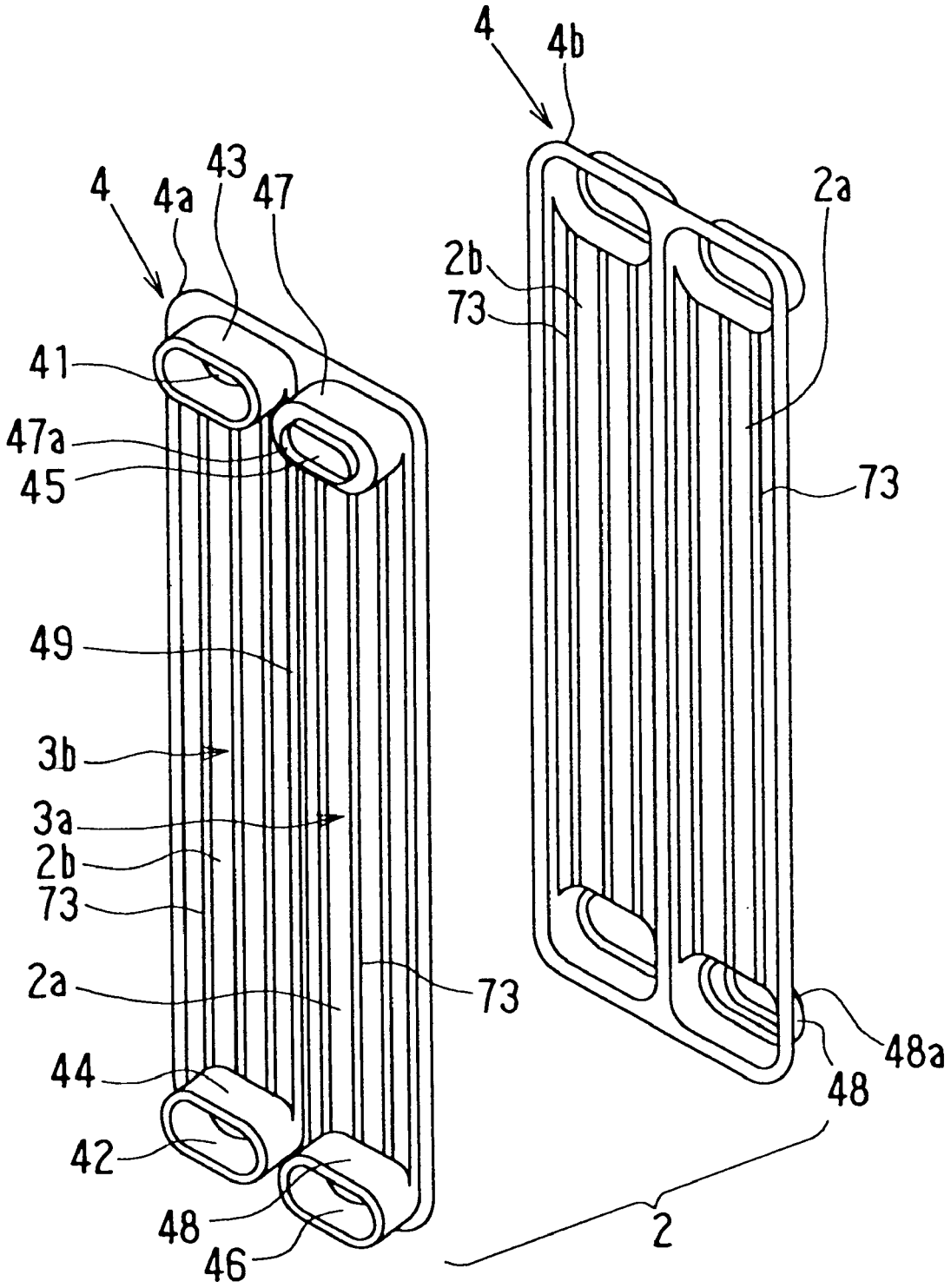
FIG. 8 is a perspective dealing view showing a tube according to the fifth embodiment.
Figure 9:
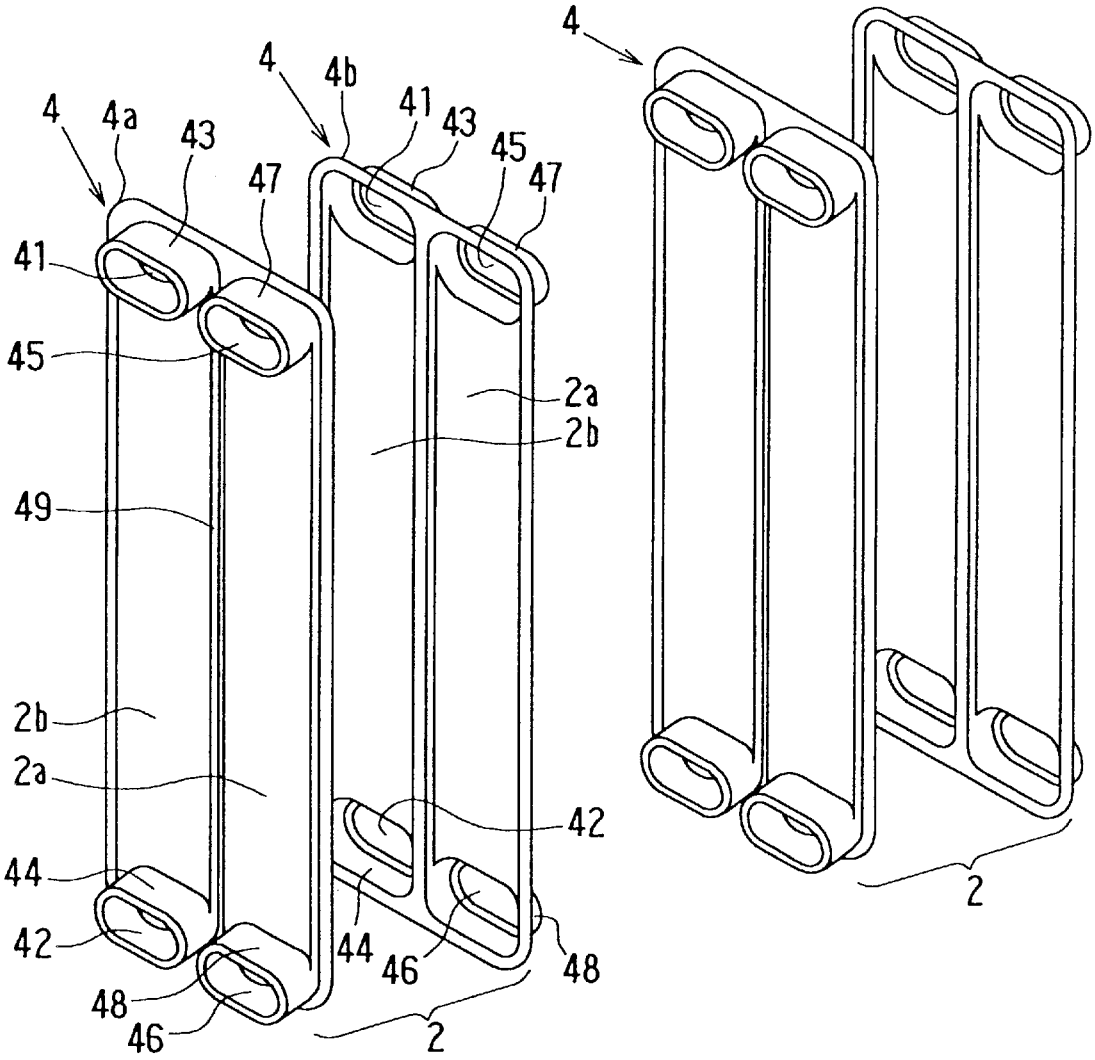
FIG. 9 is a perspective dealing view showing a principal part of the evaporator according to the prior application.

In the fifth embodiment, as shown in FIG. 8, inside the refrigerant passages 2*a* and 2*b*, a plurality of straight ribs 73 are formed, and the inner fin 70 in the first embodiment is eliminated. These straight ribs 73 are arranged in parallel to the longitudinal direction of the metal plate 4. When the coupled metal plates 4 are connected to face each other, the top surface of the straight ribs 73 formed on one metal plate 4 contacts to the inside surface of the other metal plate 4. In this way, according to the fifth embodiment, the heat transmitting surface area inside the refrigerant passages 2*a* and 2*b* is enlarged, and the strength of the tube 2 is increased at the same time.

In the above embodiments, setting the position of the coupled metal plates 4 is attained by caulking some places of the outer periphery of the coupled metal plates 4 to fix them together, or by forming some etching portions at the outer periphery of one metal plate 4 to fix the outer periphery of the other metal plate 4.

What is claimed is:

1. A refrigerant evaporator comprising:

a plurality of tubes arranged in parallel, in which an inlet side refrigerant passage and an outlet side refrigerant passage are formed, said tube being constructed by a couple of metal plates connected to face each other;

a first inlet tank portion formed at one end of each of said tubes which communications with said inlet side refrigerant passage;

a second inlet tank portion formed at the other end of each of said tubes which communicates with said inlet side refrigerant passage;

a first outlet tank portion formed at one end of each of said tubes which communicates with said outlet refrigerant passage;

a second outlet tank portion formed at the other end of each of said tubes which communicates with said outlet refrigerant passage;

a corrugated fin disposed in a space between said tubes located adjacent to each other for increasing heat exchanging efficiency;

a connecting member provided only at each of said first and said second inlet tank portions for setting a position of said tubes located adjacent to each other.

2. A refrigerant evaporator according to claim 1, wherein said first and second inlet tank portions of said tubes are communicated with each other respectively, and said first and second outlet tank portions of said tubes are communicated with each other respectively.

3. A refrigerant evaporator according to claim 1, wherein said tank portions are constructed by protruded columnar shaped portions formed at both ends of said metal plate.

4. A refrigerant evaporator according to claim 1, wherein said connecting members are protruded from one side of said inlet tank portions and inserted into the other side of said inlet tank portions located adjacent thereto.

5. A refrigerant evaporator according to claim 1, wherein one of said connecting members is protruded from one side of said first inlet tank portion and inserted into the other side of said first inlet tank portion located adjacent thereto, and one other of said connecting members is protruded from the other side of said second inlet tank portion and inserted into one side of said second inlet tank portion.

6. A refrigerant evaporator according to claim 1, wherein said tank portions are formed into a same shape.

7. A refrigerant evaporator comprising:

an inlet side heat exchanging portion for carrying out a heat exchange between refrigerant flowing in a plurality of inlet side refrigerant passages arranged in parallel and air flowing outside thereof;

an outlet side heat exchanging portion for carrying out a heat exchange between refrigerant flowing in a plurality of outlet side refrigerant passages arranged in parallel and air flowing outside thereof;

a first inlet tank portion formed at one end of said inlet side refrigerant passage to communicate with said inlet side refrigerant passage;

a second inlet tank portion formed at the other end of said inlet side refrigerant passage to communicate with said inlet side refrigerant passage;

a first outlet tank portion formed at one end of said outlet side refrigerant passage to communicate with said outlet side refrigerant passage; and a second outlet tank portion formed at the other end of said outlet refrigerant passage to communicate with said outlet side refrigerant passage, wherein said inlet side refrigerant passage and said outlet side refrigerant passage are formed in a tube constructed by a couple of metal plates connected to face each other;

said inlet side heat exchanging portion and said outlet side heat exchanging portion are formed integrally with each other by laminating said tubes; and in said tubes located adjacent to each other, connecting members are provided only at said first and second inlet tank portions for setting a position of said tubes.

8. A refrigerant evaporator according to claim 7, wherein said first inlet tank portion and said second inlet tank portion of each tube communicate with each other respectively; and said first outlet tank portion and said second outlet tank portion of each tube communicate with each other respectively.

9. A refrigerant evaporator according to claim 7, wherein, in said tubes located adjacent to each other, said connecting members are protruded from said first and second inlet tank portions of one tube and inserted into said first and second inlet tank portions of the other tube.

10. A refrigerant evaporator according to claim 7, wherein, said connecting member is constituted by a first connecting member and a second connecting member, in said tubes located adjacent to each other, said first connecting member is protruded from said first inlet tank portion of one tube and inserted into said first inlet tank portion of the other tube, and said second connecting member is protruded from said second inlet tank portion of the other tube and inserted into said second inlet tank portion of one tube.

11. A refrigerant evaporator comprising:

a plurality of tubes arranged in parallel, in which an inlet side refrigerant passage and an outlet side refrigerant passage are formed, said tube being constructed by a couple of metal plates connected to face each other;

a first inlet tank portion formed at one end of each of said tubes which communications with said inlet side refrigerant passage;

a second inlet tank portion formed at the other end of each of said tubes which communicates with said inlet side refrigerant passage;

a first outlet tank portion formed at one end of each of said tubes which communicates with said outlet refrigerant passage;

a second outlet tank portion formed at the other end of each of said tubes which communicates with said outlet refrigerant passage;

a connecting member provided only at each of said first and said second inlet tank portions for setting a position of said tubes located adjacent to each other.

* * * * *

UNITED STATES PATENT AND TRADEMARK OFFICE

CERTIFICATE OF CORRECTION

PATENT NO. : 5,918,664

DATED : July 6, 1999

INVENTOR(S) : Eiichi Torigoe

It is certified that error appears in the above-identified patent and that said Letters Patent is hereby corrected as shown below:

Col. 1, line 39, delete "show" and substitute --shown-- therefor

Col. 8, line 2, claim 1, delete "communications" and substitute -- communicates -- therefor Col. 10, line 11, claim 11, delete "communications" and substitute -- communicates -- therefor Signed and Sealed this Eighteenth Day of April, 2000

*Attest:*

Q. TODD DICKINSON

*Attesting Officer*

*Director of Patents and Trademarks*